US010471435B2

(12) United States Patent
Graf et al.

(10) Patent No.: US 10,471,435 B2
(45) Date of Patent: Nov. 12, 2019

(54) HAMMER FOR SHREDDING MACHINES

(71) Applicant: ESCO Corporation, Portland, OR (US)

(72) Inventors: David M. Graf, Scappoose, OR (US); Michael R. Weeks, Portland, OR (US); John P. Hoice, Vancouver, WA (US); Daniel R. Morrow, Portland, OR (US); Terry L. Briscoe, Portland, OR (US); Christopher M. Carpenter, Tualatin, OR (US)

(73) Assignee: ESCO GROUP LLC, Portland, OR (US)

( * ) Notice: Subject to any disclaimer, the term of this patent is extended or adjusted under 35 U.S.C. 154(b) by 0 days.

(21) Appl. No.: 15/824,705

(22) Filed: Nov. 28, 2017

(65) Prior Publication Data

US 2018/0085758 A1 Mar. 29, 2018

Related U.S. Application Data

(62) Division of application No. 13/897,340, filed on May 17, 2013, now Pat. No. 9,855,560.

(60) Provisional application No. 61/649,019, filed on May 18, 2012.

(51) Int. Cl.

| | |
|---|---|
| ***B02C 13/28*** | (2006.01) |
| ***B02C 13/04*** | (2006.01) |
| ***B02C 13/284*** | (2006.01) |

(52) U.S. Cl.

CPC ..... *B02C 13/28* (2013.01); *B02C 13/04* (2013.01); *B02C 13/284* (2013.01); *B02C 2013/2808* (2013.01)

(58) Field of Classification Search

CPC ..... B02C 13/28; B02C 13/04; B02C 13/284; B02C 2013/2808

USPC ..... 241/189.1, 194, 195, 197

See application file for complete search history.

(56) References Cited

U.S. PATENT DOCUMENTS

| | | | |
|---|---|---|---|
| 1,132,047 | A | 3/1915 | Thompson |
| 1,281,829 | A | 10/1918 | Plaisted |
| 1,301,316 | A | 4/1919 | Plaisted |
| RE14,865 | E | 5/1920 | Plaisted |
| 1,456,987 | A | 5/1923 | Lucas |
| 1,618,826 | A | 2/1927 | Hiller |
| 1,630,021 | A | 5/1927 | Lucas |
| 1,717,759 | A | 6/1929 | Briggs |

(Continued)

FOREIGN PATENT DOCUMENTS

| | | |
|---|---|---|
| CN | 201108844 | 9/2008 |
| CN | 2257217 | 11/2011 |

(Continued)

*Primary Examiner* — Anthony D Stashick
*Assistant Examiner* — Onekki P Jolly
(74) *Attorney, Agent, or Firm* — Steven Schad

(57) ABSTRACT

Shredder hammers having first and second major surfaces on opposing sides, and a circumferential edge. A mounting portion includes a mounting hole that extends from the first major surface to the second major surface, and is configured to receive a hammer mounting pin for mounting in a reducing system. The circumferential edge includes a primary impact face to initially impact materials to be reduced and a wear edge to subsequently crush and shear the material against a wall of the equipment. The hammer is biased forward on the pin to admit more material to be crushed between the wear edge and the grates.

6 Claims, 11 Drawing Sheets

(56) References Cited

U.S. PATENT DOCUMENTS

| | | | | | |
|---|---|---|---|---|---|
| 2,019,514 | A | | 11/1935 | Stine | |
| 2,045,690 | A | | 6/1936 | Armstrong | |
| 2,331,597 | A | | 10/1943 | Coles | |
| 2,467,865 | A | * | 4/1949 | Smith | B02C 13/28 241/194 |
| 2,912,176 | A | * | 11/1959 | Jordan | E03C 1/2665 241/194 |
| 2,950,066 | A | | 8/1960 | Smith | |
| 3,025,067 | A | | 3/1962 | Raney et al. | |
| 3,510,076 | A | * | 5/1970 | Perdue | B02C 13/28 241/197 |
| 3,727,848 | A | | 4/1973 | Francis | |
| 3,838,826 | A | * | 10/1974 | Wallace | B02C 13/2804 241/197 |
| 3,844,494 | A | | 10/1974 | Hightower | |
| 4,000,859 | A | | 1/1977 | Whitney | |
| 4,049,202 | A | | 9/1977 | Schmidt | |
| 4,060,961 | A | | 12/1977 | Anderson et al. | |
| 4,117,985 | A | * | 10/1978 | Lazareck | B02C 13/28 241/197 |
| 4,141,512 | A | * | 2/1979 | Francis | B02C 13/28 241/194 |
| 4,146,185 | A | | 3/1979 | Schober | |
| 4,202,504 | A | | 5/1980 | Cameron | |
| 4,310,125 | A | | 1/1982 | Novotny | |
| 4,313,575 | A | | 2/1982 | Stepanek | |
| 4,373,679 | A | | 2/1983 | Kawano et al. | |
| 4,558,826 | A | | 12/1985 | Martinek | |
| 4,600,160 | A | | 7/1986 | Mengel et al. | |
| 4,662,570 | A | | 5/1987 | Heeren et al. | |
| 5,072,888 | A | | 12/1991 | Stelk | |
| 5,272,861 | A | | 12/1993 | Roynberg | |
| 5,285,974 | A | * | 2/1994 | Cesarini | B02C 13/28 241/194 |
| 5,381,976 | A | | 1/1995 | Chon et al. | |
| 5,490,637 | A | | 2/1996 | Golesis | |
| 5,562,257 | A | | 10/1996 | Graveman et al. | |
| 5,598,981 | A | | 2/1997 | Hellmich | |
| D402,674 | S | | 12/1998 | McLeod | |
| 5,975,167 | A | | 11/1999 | Brown | |
| D426,556 | S | | 6/2000 | Bradley | |
| 6,102,312 | A | | 8/2000 | Aberle | |
| 6,527,210 | B1 | | 3/2003 | Mecklenfeld | |
| D494,607 | S | | 8/2004 | Hunag | |
| 6,971,598 | B2 | * | 12/2005 | Schillinger | B02C 13/28 241/194 |
| D536,351 | S | | 2/2007 | Young | |
| D541,846 | S | | 5/2007 | Lo | |
| D545,328 | S | | 6/2007 | Young | |
| D552,638 | S | | 10/2007 | Willibald | |
| 7,325,761 | B2 | | 2/2008 | Chen et al. | |
| D574,400 | S | | 8/2008 | Willibald | |
| 7,850,107 | B2 | | 12/2010 | Schafer | |
| D632,730 | S | | 2/2011 | Lo | |
| 8,231,072 | B2 | | 7/2012 | Willibald | |
| 8,308,094 | B2 | | 11/2012 | Hoice et al. | |
| D681,081 | S | | 4/2013 | Neal, Jr. et al. | |
| 9,327,287 | B2 | | 5/2016 | Doppstadt et al. | |
| 9,855,560 | B2 | | 1/2018 | Graf et al. | |
| 2005/0258289 | A1 | * | 11/2005 | Chen | B02C 13/28 241/194 |
| 2006/0226269 | A1 | | 10/2006 | Stelk | |
| 2012/0234953 | A1 | | 9/2012 | Risi | |
| 2013/0233955 | A1 | | 9/2013 | Morrow et al. | |
| 2013/0277476 | A1 | | 10/2013 | Doppstadt et al. | |
| 2014/0299689 | A1 | | 10/2014 | Morrow et al. | |

FOREIGN PATENT DOCUMENTS

| | | |
|---|---|---|
| CN | 102413937 | 4/2012 |
| GB | 348736 | 5/1931 |
| JP | 2002-331247 | 11/2002 |
| JP | 2003-284964 | 7/2003 |
| RU | 2330721 | 8/2008 |
| SU | 264149 | 1/1970 |
| SU | 893255 | 12/1980 |

* cited by examiner

HAMMER FOR SHREDDING MACHINES

RELATED APPLICATION

This application is a divisional of pending application Ser. No. 13/897,340, filed May 17, 2013, entitled "Hammer for Shredding Machines," now U.S. Pat. No. 9,855,560, which claims priority to U.S. Provisional Patent Application No. 61/649,019, filed May 18, 2012 entitled "Asymmetrical Impact Hammers." Each of these applications are incorporated by reference herein in its entirety and made a part hereof.

FIELD OF THE INVENTION

The present invention relates to industrial shredding systems. More particularly, this invention relates to shredding systems that include shredder hammers.

BACKGROUND OF THE INVENTION

Industrial shredding equipment typically is used to break large objects into smaller pieces that can be more readily processed, for example as in the recycling industry. Commercially available shredders range in size from those that shred materials like rubber (e.g., car tires), wood, and paper to larger shredding systems that are capable of shredding scrap metal, automobiles, automobile body parts, and the like.

The core of most industrial shredding systems is the shredding chamber, where multiple shredder hammers are spun on a rotary shredding head, and repeatedly impact the material to be shredded against an anvil or other hardened surface. Shredder hammers are therefore routinely exposed to extremely harsh conditions of use, and so typically are constructed from hardened steel materials, such as low alloy steel or high manganese alloy content steel (such as Hadfield Manganese Steel).

Shredder hammers may each weigh several hundred pounds (e.g., 150 to 1200 lbs.). During typical shredder operations these heavy hammers impact the material to be shredded at relatively high rates of speed. Even when employing hardened materials, the typical lifespan of a shredder hammer may only be a few days to a few weeks. In particular, as the shredder hammer blade or impact area undergoes repeated collisions with the material to be processed, the material of the shredder hammer tends to wear away.

It should be appreciated that the greater throughput that the shredding equipment can process, the more efficiently and profitably the equipment can operate. Accordingly, there is room in the art for improvements in the structure and construction of shredder hammers and the machinery and systems utilizing such hammers.

Examples of shredder hammers and industrial shredding equipment are disclosed in U.S. Pat. Nos. RE14865, 1,281,829, 1,301,316, 2,331,597, 2,467,865, 3,025,067, 4,049,202, 4,310,125, 4,373,679, 6,102,312 and 7,325,761. The disclosures of these and all other publications referenced herein are incorporated by reference in their entirety for all purposes.

SUMMARY OF THE DISCLOSURE

The present invention generally pertains to shredding operations and to hammers that increase throughput with improved hammer design and coordination between the hammer and the opposing grates.

In the present invention, the hammer improves the intake and working of material between the outer wear edge of the hammer and the opposing grates through which the shredded material exits the shredding chamber. The ability to feed more material between the hammer and the grate and to shred the introduced material more effectively results in increased production throughput for the shredding machine.

In one aspect of the invention, the lateral extension of the hammer is greater in the trailing direction to provide an increased acceptance gap and/or to maintain the acceptance gap more fully open over time and/or to return to an open position more quickly. Improved shredding and higher rates of discharge from the shredding chamber is achieved by hammers of the invention on account of this greater feeding of material along the wear edge.

In another aspect of the invention, the hammer is formed with a trailing section having a greater mass than a leading section of the hammer to achieve improved feeding and usage of the acceptance gap and wear edge of the hammer. The trailing and leading sections are defined by a longitudinal axis extending through the mounting hole center and a midpoint of the wear edge.

In another aspect of the invention, the hammer is formed with an extended wear edge by which the hammer can more effectively crush, break and shred the material in cooperation with the opposing grate. The length of the wear edge is related to the hammer size. To increase production without undue detrimental effects caused by increased hammer width, the ratio of the hammer height to length of the wear edge (H/L) is preferably less than 0.75. In one embodiment of the invention, the wear edge is an arc to maximize the mass in the working portion and/or to provide effective coordination with the grate to shred and discharge the material.

In another aspect of the invention, the wear edge of the hammer extends farther from the center of gravity axis in the trailing direction than in the leading direction, where the center of gravity axis extends through the center of the mounting hole and the center of gravity.

In another aspect of the invention, the hammer is configured such that the angle defined between the trailing axis and the center of gravity axis is greater than the angle between the leading axis and the center of gravity axis. All three axes intersect through the mounting hole center with the center of gravity axis extending through the center of gravity, the trailing axis extending through the trailing end of the wear edge, and the leading axis extending through the leading end of the wear edge.

In another aspect of the invention, the centers of mass of the leading region and of the trailing region are defined within the angle between the leading axis and the trailing axis. Such a configuration provides an effective coordination of wear edge length and working portion mass to improve shredding of the material in the shredding chamber.

In another aspect of the invention, a shredding machine includes one or more hammers with one or more of the above-noted inventive features. Such a machine provides a shredding process that produces increased throughput of the target material. It is further believed that the process provides greater reduction of the target material for easy and better downstream processing of the target material.

In another aspect, the invention includes shredder hammers comprising a pair of major surfaces, a circumferential edge connecting the major surfaces including a wear edge and a hole extending through the hammer and opening in each of the major surfaces to receive a support pin for mounting the shredder hammer in a shredding machine. A working portion of the hammer remote from the hole includes the wear edge. A larger acceptance gap is defined where material is primarily separated and reduced between the wear edge proximate the impact face and a wall of the shredding machine.

In the various embodiments shown in the drawings, the invention includes shredder hammers with mass shifted away from the primary impact face rearward so the hammer rotates forward on the mounting pin relative to conventional symmetrical hammers to create an increased acceptance gap between the hammer and a grate of the shredder.

In an alternative embodiment an asymmetric hammer comprises two opposite surfaces and a peripheral rim connecting the two opposite surfaces including a wear edge. The hammer also comprises a center of gravity and a hole at a mounting portion extending through the hammer and opening in each of the opposite surfaces to receive a support pin for mounting the shredder hammer in a shredding machine. The wear edge, which is remote from the mounting portion, terminates at a leading face at a first end and at a trailing face at a second end. The leading face and the trailing face extend from the wear edge toward the mounting portion. A center of gravity axis passes through the center of gravity and through the center of the hole defining a trailing region including a trailing periphery and a leading region including a leading periphery. The trailing periphery extends beyond the leading periphery of the leading region when the leading region is projected across the center of gravity axis and superimposed over the trailing region.

In an alternative embodiment, the invention comprises a hammer with two major surfaces, a peripheral rim connecting the two major surfaces including a wear edge, a center of gravity, and a hole extending through the hammer and opening in each of the major surfaces to receive a support pin for mounting the shredder hammer in a shredding machine. A center of gravity axis passes through the center of gravity and the center of the hole. The wear edge remote from the hole includes a leading end and a trailing end. A leading axis extends from the center of the hole to the leading end of the wear edge, and a trailing axis extends from the center of the hole to the trailing end of the wear edge. The inclination between the center of gravity axis and the trailing axis is greater than the inclination between the center of gravity axis and the leading axis.

In an alternative embodiment, the invention includes a shredder hammer comprising a pair of major surfaces, a circumferential edge connecting the major surfaces including a wear edge, a center of gravity, and a mounting portion including a hole extending through the hammer and opening in each of the major surfaces to receive a support pin for mounting the shredder hammer in a shredding machine. A center of gravity axis extends through the center of the hole and the center of gravity. A working portion of the hammer remote from the hole includes the wear edge. The wear edge terminates at a leading impact face and at a trailing face. A transverse line perpendicular to the center of gravity axis defines an outer datum that extends from the intersection of the axis with the wear edge toward the leading end. An acceptance gap is defined by the distance between the wear edge at the leading end and the outer datum. In accordance with the present invention, the acceptance gap is at least 21 percent of the leading axis distance, i.e., the distance from the center of the mounting hole to the wear edge at the leading end.

In an alternative embodiment the invention includes an asymmetric hammer comprising a first surface and a second surface, an edge connecting the first surface and the second surface and including a wear edge describing an arc terminating at a first face and a second face. The hammer also comprises a center of gravity and a hole extending through the hammer and opening at the first surface and the second surface to receive a support pin for mounting the shredder hammer in a shredding machine. A center of gravity axis passes through the center of gravity and through the center of the hole defining a trailing region with the trailing face and a leading region with the leading face. A transverse line defines an outer datum perpendicular to the center of gravity axis and extends from the center of gravity axis where it meets the wear edge. An acceptance gap angle is defined by the outer datum line and a gap line that extends from the intersection of the outer datum and the wear edge to the leading end of the wear edge. In one aspect of the invention, the acceptance gap angle is at least 19 degrees.

In an alternative embodiment, the invention comprises a reducing system to separate material including a shredding chamber with walls that encloses a rotary shredding head with a plurality of shredder hammers pivotally mounted by a support pin to the rotary shredding head. At least one shredder hammer has a pair of major surfaces, a circumferential surface connecting the major surfaces including a wear edge, a hole extending through the hammer and opening in each of the major surfaces to receive the support pin and a center of gravity. A center of gravity axis extends through the center of the hole and the center of gravity. A working portion of the hammer remote from the hole includes the wear edge. The wear edge extends between a leading or primary impact face and a trailing or secondary impact face that together with an opposing portion of the chamber walls define a compression zone for reducing material. The compression zone is bounded by an angle between the center of gravity axis and a line from the center of the hole to the wear edge at the leading impact face and the angle is greater than 38 degrees.

In an alternative embodiment, the invention includes an asymmetric hammer comprising two opposite surfaces, a peripheral rim connecting the two opposite surfaces including a wear edge, a center of gravity, and a hole extending through the hammer and opening in each of the major surfaces to receive a support pin for mounting the shredder hammer in a shredding machine. The wear edge is remote from the hole and describes an arc that terminates at a leading face and a trailing face. A center of gravity axis passing through the center of gravity and through the center of the hole defines a trailing region including the trailing face and a leading region including the leading face where a line between the center of the hole and the terminus of the wear edge at the leading impact face is inclined to the center of gravity axis by at least 38 degrees.

In an alternative embodiment, the invention includes a hammer for a shredding machine comprising a mounting hole for mounting the hammer in the shredding machine, a center of gravity and a center of gravity axis extending through a center of the mounting hole and the center of gravity. The center of gravity axis defines a leading portion on one side of the center of gravity axis with a leading center of mass and a trailing portion on the other side of the center of gravity axis with a trailing center of mass. The leading center of mass is closer to the center of the mounting hole than the trailing center of mass.

Other aspects, advantages, and features of the invention will be described in more detail below and will be recognizable from the following detailed description of example structures in accordance with this disclosure.

DETAILED DESCRIPTION OF THE DISCLOSURE

Figure 1:
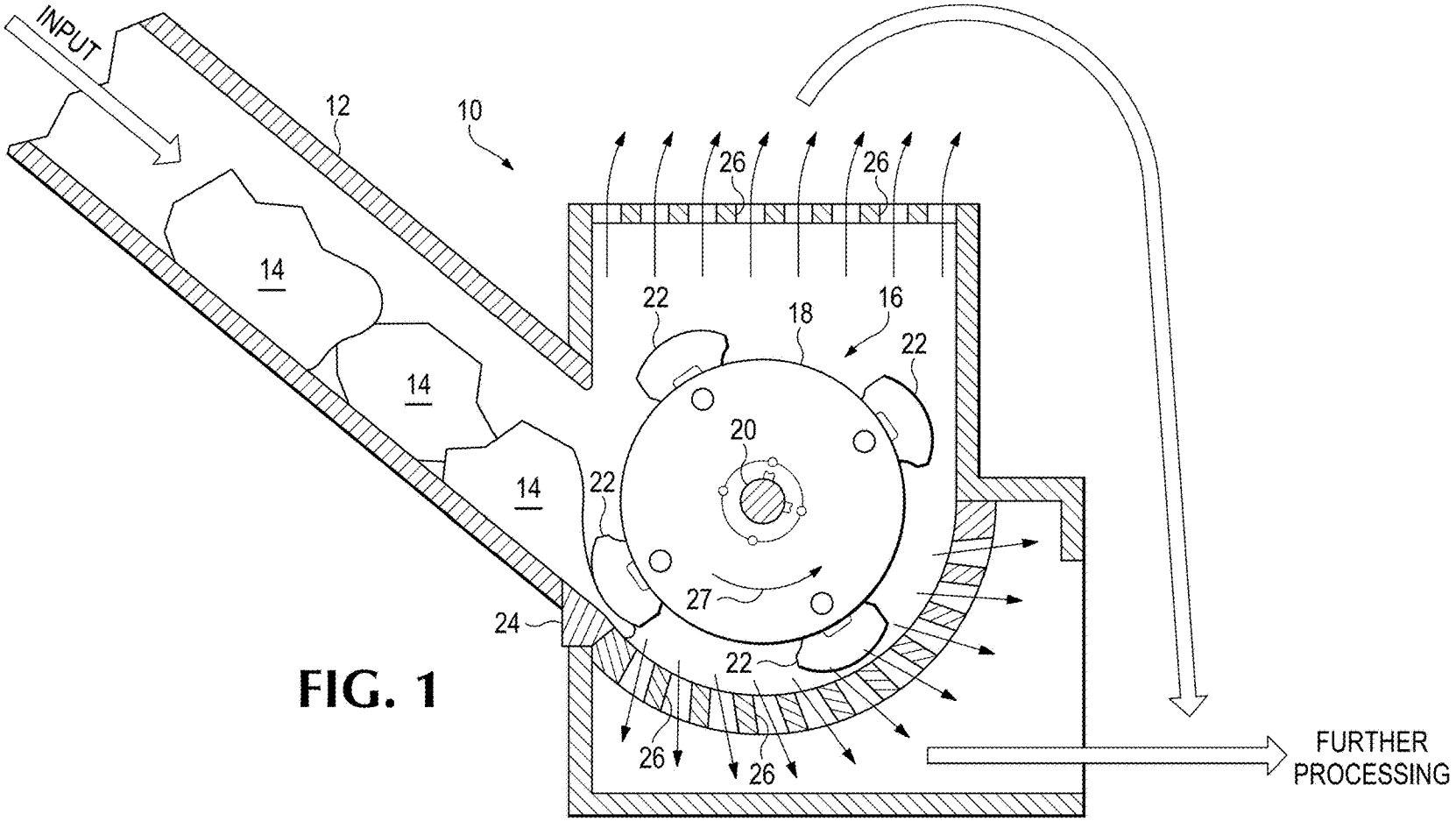
FIG. 1 is a schematic depiction of a shredding system according to an exemplary embodiment of the present invention.

Hammers in reduction systems operate at very high speeds to impact and separate materials into smaller portions allowing them to be further processed in downstream operations. The hammers are mounted to a head and are rotated inside a housing. The target material is initially impacted by a leading impact face of the hammer passing an anvil or cutter bar near the material inlet. Contact of the hammers with the material fed into the shredding machine fractures, compresses and shears the material into smaller pieces. The target material is reduced in size as the materials are compressed and shredded between the outer surface (i.e., the wear edge) of the hammer and the grates forming a portion of the walls of the reducing system. These grates define openings that allow the material to exit when small enough to pass through the grate openings.

With no material in the housing of the system, the head with the hammers rotates at operating speeds. The hammers are typically free to rotate about the mounting pins during operation. In the unloaded state under centrifugal force the hammers extend generally directly away from the axis of rotation and the hammer center of gravity axis coincident with the center of the head. In response to material in the system contacting the hammer leading edge, the hammers deflect and rotate backwards on the mounting pins as the hammers impact the material and crush it against the grates.

The configuration of the outer surface or wear edge on a typical symmetric hammer reflects the circumference of rotation of the hammer around the pin. This circumference of rotation is smaller than the curvature of the grates which corresponds to the circumference of rotation of the head with a set of hammers. Hammers are typically symmetrically shaped to permit reversible mounting. The conventional approach to efficient shredding of material is to provide a substantial mass for the leading impact face to crush and tear up the material. Some hammers are asymmetrically loaded to provide a greater mass of material at the leading end in an effort to increase service life, but this acts to reduce the acceptance gap.

While mass and impact energy are beneficial to shredding material, the throughput of material through the shredding machine can be substantially improved by improving the working of the material between the wear edge of the hammer and the opposing grates. This can be done by increasing the opening at the leading end of the hammer's outer surface (i.e., the acceptance gap between the leading end of the hammer's outer surface and an opposing grate), and/or biasing the hammer forward to maintain the acceptance gap more fully open over time and/or returning the hammer more quickly to an open position. An increased or more open acceptance gap enables a greater amount of unshredded material to be fed between the hammer and the grate where the material can be effectively shredded, crushed, reduced and forced through the openings in the grate. This results in increased production and greater separation of the materials. The larger acceptance gap also provides additional compression of material yielding a product with increased density and in turn an increased value of that shredded product. Conventional symmetric hammers and front loaded hammers fail to provide a sufficient acceptance gap for higher production operation.

In one preferred embodiment of the invention, the hammer is given an asymmetric configuration to provide a larger acceptance gap and bias the acceptance gap to the open position to more effectively reduce the target material to be shredded. The wear edge is preferably arcuate to maximize the available clearance with increased mass and to effectively cooperate with the opposing grates. The hammer has a greater lateral extension in the trailing direction and/or a greater mass in the trailing region to bias the leading surface forward for improved receipt of material into the acceptance gap.

FIG. 1 schematically illustrates an exemplary industrial shredding system 10. Shredding system 10 includes a material intake (such as chute 12) that introduces material 14 to be shredded to a shredding chamber 16. The material 14 to be shredded may be of any desired size or shape. The material 14 is optionally pretreated, such as by heating, cooling, crushing, baling, etc. before being introduced into the shredding chamber 16. The material intake 12 may optionally include feed rollers or other machinery to facilitate feeding material 14 to chamber 16, and/or to control the rate at which material 14 enters chamber 16, and/or to prevent the material 14 from moving backward up the chute 12. A portion of the walls of chamber 16 includes grates 26 that allow material reduced below a certain size to pass out of the chamber.

Figure 4A:
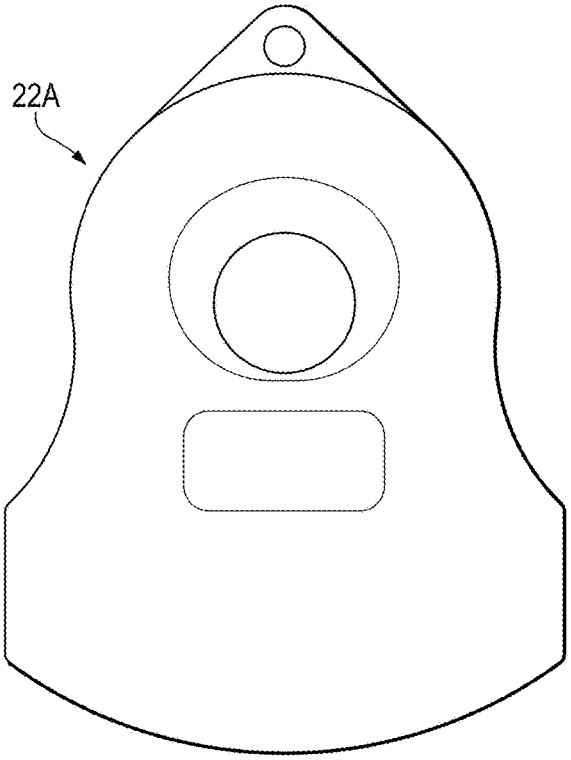
FIG. 4A PRIOR ART
FIGS. 4A and 4B are perspective views of conventional symmetric hammers used in the rotating head of a shredding system.
Figure 4B:
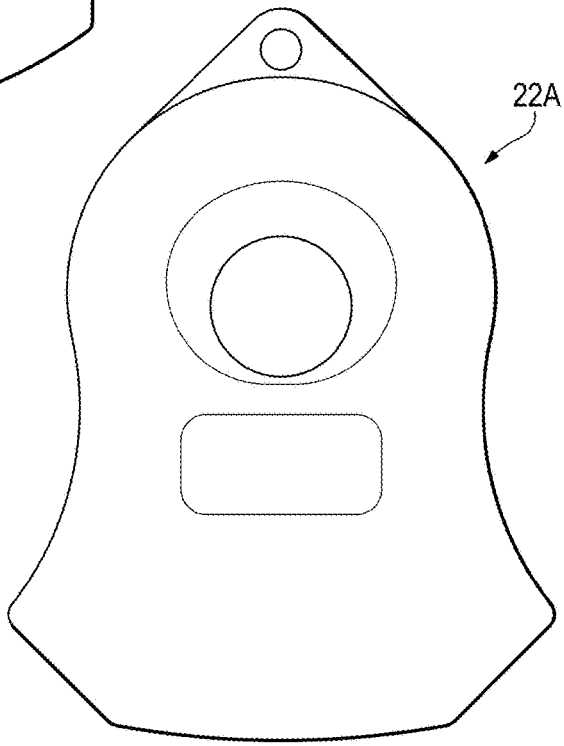
FIG. 4B PRIOR ART
Figure 5:
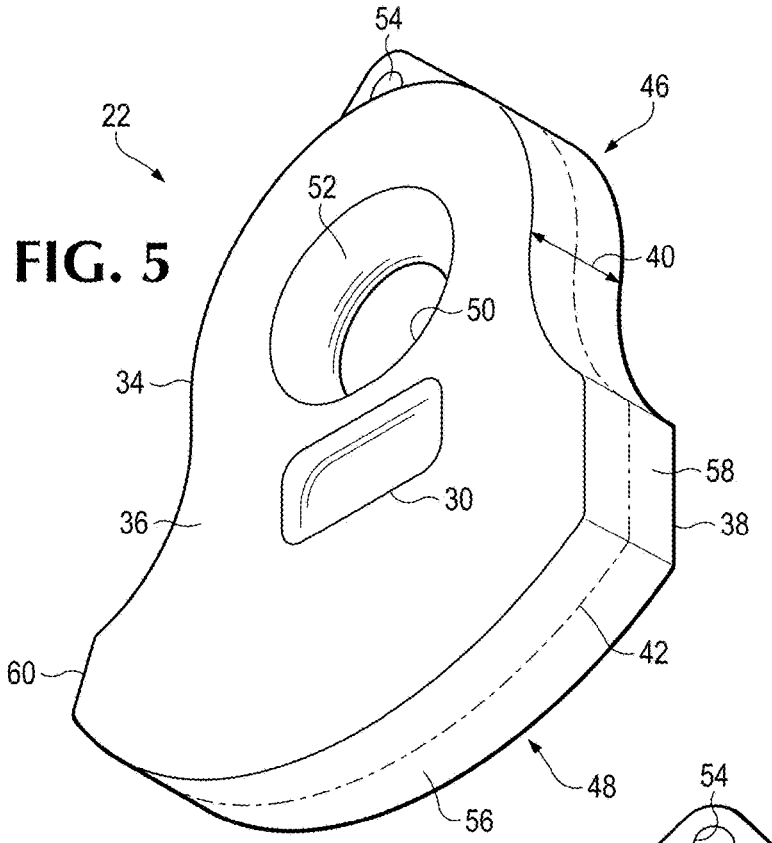
FIG. 5 is a perspective view of one embodiment of a hammer in accordance with the present invention.
Figure 6:
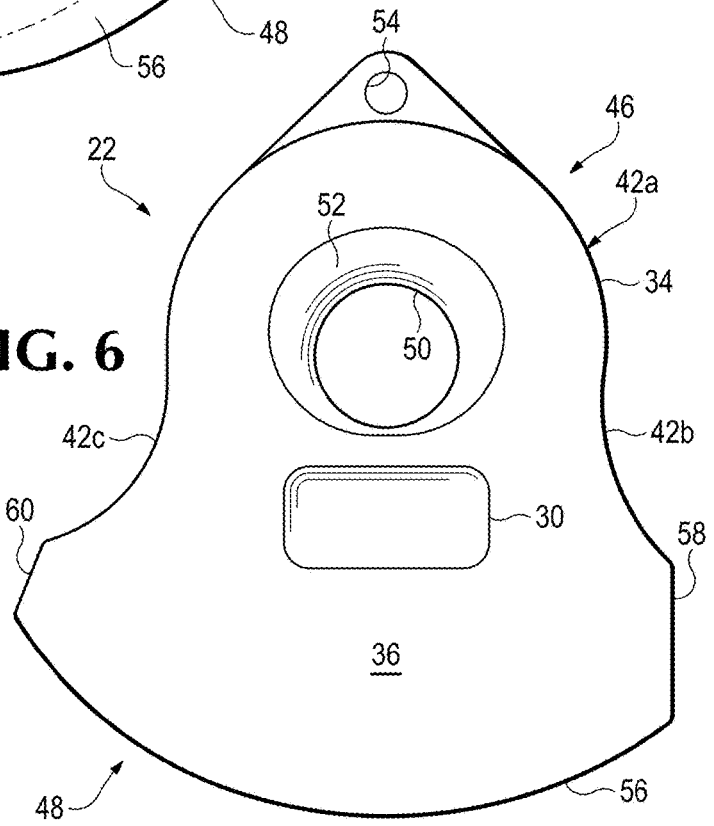
FIG. 6 is a front view of the inventive hammer.
Figure 10:
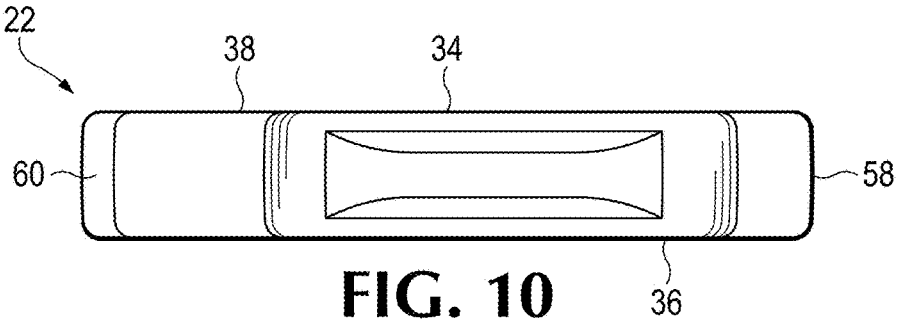
FIG. 10 is a top view of the inventive hammer.
Figure 7:
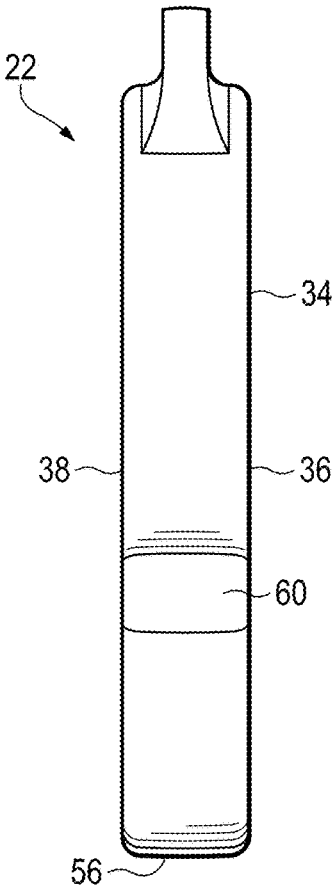
FIG. 7 is a side view of one side of the inventive hammer.
Figure 8:
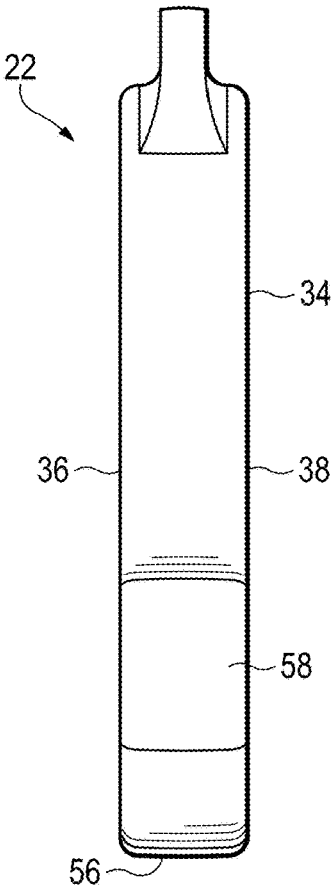
FIG. 8 is a side view of the other side of the inventive hammer.
Figure 9:
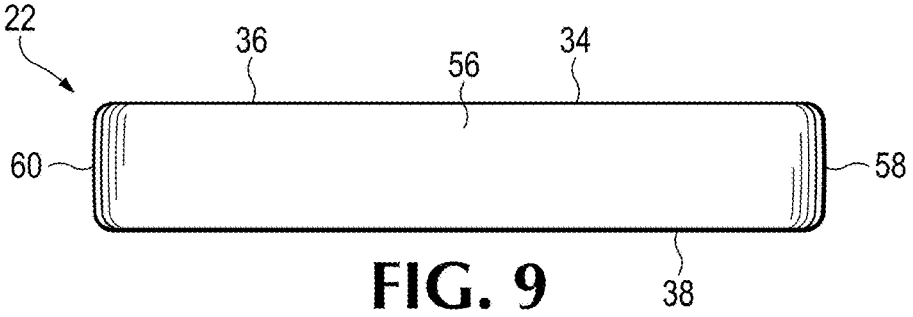
FIG. 9 is a bottom view of the inventive hammer.

Within shredding chamber 16 is a rotary shredding head 18, with a direction of rotation indicated by arrow 27. Although the disclosure depicts a particular rotary shredding head, it should be appreciated that the present invention is usable across a wide range of shredding machines including, for example, a variety of rotor configurations such as disc rotors, spider rotors, barrel rotors, and the like. Rotary shredding head 18 is configured to rotate about a shaft or axis 20, and is equipped with a plurality of shredder hammers 22 according to the present invention. Each shredder hammer 22 is independently pivotally mounted to the rotary shredding head. In response to centrifugal forces as shredding head 18 rotates, each hammer extends outward, tending toward a position where the center of gravity of each hammer is spaced outward as far as possible from rotation axis 20. Although the exclusive use of hammers in accordance with the present invention is preferred, the inventive hammers could be used in combination with conventional hammers, and the invention pertains to systems having at least one inventive hammer. Examples of conventional symmetrical shredding hammers 22A are shown in FIG. 4.

As rotary shredding head 18 rotates, the shredder hammers impact the material 14 to be shredded, and crush the material against anvil 24, grates 26, chamber walls or adjacent hammers to break the material apart. The resulting shredded materials may be discharged from the shredding chamber 16 through any one of the grates 26 leading from the shredding chamber. As shown in FIG. 1, suitable grates 26 may be provided in the bottom, top, and/or one or more sides of the chamber 16 walls. The shredded material may then be transported for collection and further processing.

Figure 2:
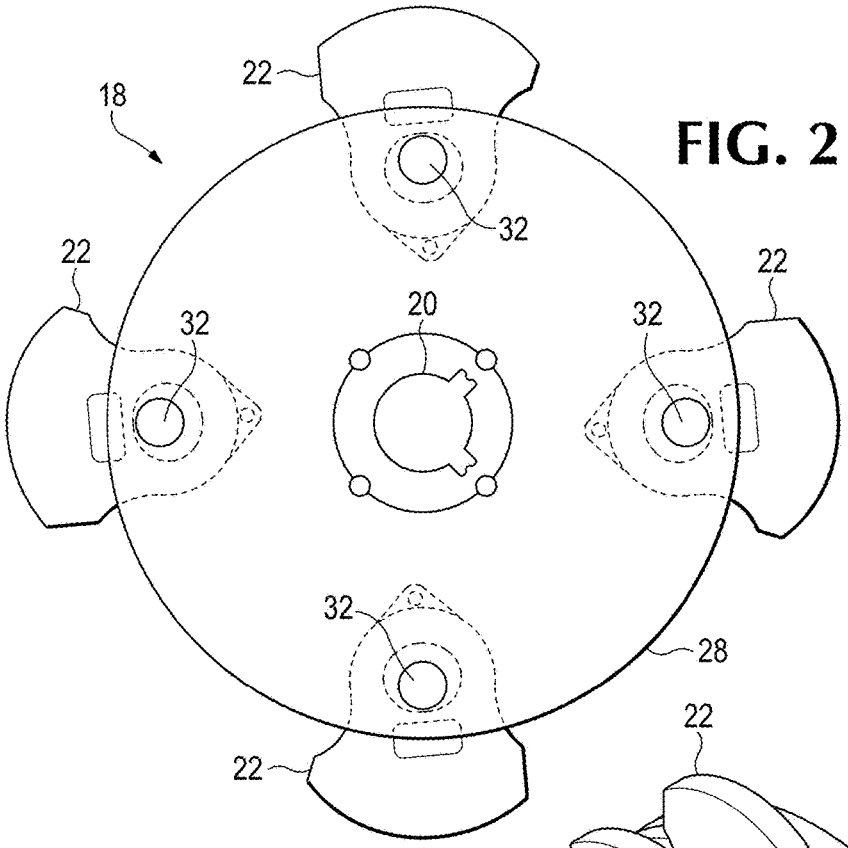
FIG. 2 is an elevation view of the end of a rotating head for a shredding system with hammers.
Figure 3:
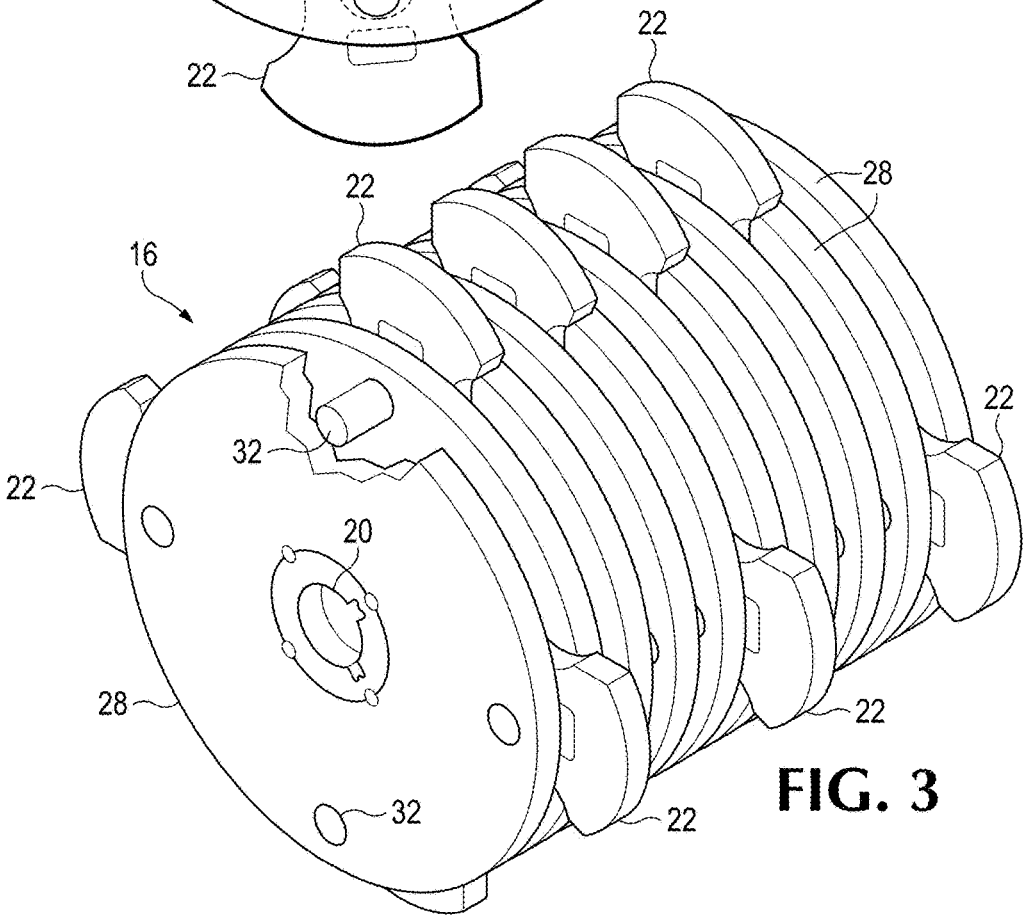
FIG. 3 is a perspective view of the rotating head of FIG. 2.

The wide variety of applications for these machines, from clay processing to automobile shredding, results in a wide range and variety of shredder configurations. FIG. 2 shows one example of a shredding head 18. Rotary shredding head 18 includes a plurality of rotor disks 28 that are separated from one another by spacers that are configured to be mounted around the drive shaft 20. While any number of rotor disks 28 may be utilized in a rotary shredding head, the illustrated example of shredding head 18 includes ten disks 28. Disks 28 may be fixedly mounted with respect to the shaft 20, for example by welding, mechanical coupling, etc., to allow the disks 28 to be rotated when shaft 20 is rotated by an external motor or other power source (not shown). In addition to providing a spacing function, spacers can also help protect the shaft 20 from damage, due to contact with material 14 as it is being shredded, or fragments of broken shredder hammers 22, and the like.

The rotary shredding head 18 further includes a plurality of hammer mounting pins 32 that extend between at least some of the rotor disks 28 and/or through the entire length of the shredding head 18. The shredder hammers 22 are rotatably mounted on the hammer mounting pins 32 so that they are capable of freely and independently rotating around the mounting pins. In this illustrated example, the shredding head 18 includes four mounting pins 32 around the circumference of the rotor disks 28, and shredder hammers 22 are shown mounted on selected pins 32 between each adjacent pair of rotor disks 28. It is recognized that two, three, four or more hammers can be mounted between adjacent disks depending on the specific application. The particular distribution of hammers may be modified as required by the end user, depending on end-user needs, although the hammers are typically positioned so that the shredding head is balanced with respect to rotation. As with the variety of reducing machines for different applications, there are a wide range of hammers to be used in the machines.

The mounting pins 32, shredder hammers 22, and rotor disks 28 may be structured and arranged so that, in the event that a shredder hammer 22 is unable to completely pass through the material 14, it can rotate to a location between adjacent disks 28 and thereby pass by the material 14 until it is able to extend outward again in response to rotation of the shredder head 18 or additional material interaction. Alternatively, or in addition, the shredder hammer 22 may shift sideways on its mounting pin 32 as it passes by or through the material 14 to be shredded.

Shredder hammers used in the art of industrial shredder construction and operation typically are constructed from especially durable materials, such as hardened steel alloys. Exemplary materials suitable for the fabrication of shredder hammers include low alloy steel or high manganese alloy content steel, among others. Particularly preferred are so-called work hardening steel alloys, a family of steel formulations that become harder the more it is subjected to impacts and/or compressive forces. One such manganese alloy is Hadfield Manganese steel, which contains about 11% to about 14% manganese, by weight. The under layer typically remains ductile and tough. However, as the surface of the shredder hammer wears, the layer of material exhibiting increased hardness is renewed, gradually increasing in depth as the hammer surface is worn away.

One embodiment of shredding hammer 22 is depicted in FIGS. 5-15. Shredder hammer 22 has a plate-like hammer body 34 that includes a first major surface 36 and a second major surface 38 defining opposite sides of the hammer. Major surface 36 and major surface 38 are separated by the thickness 40 of the hammer. The thickness 40 of the hammer may be substantially constant, or it may vary over the area of the hammer.

The shape of the hammer is largely defined by a circumferential edge or rim 42 which extends between the first and second major surfaces 36 and 38. The circumferential edge 42 is, in this embodiment, substantially perpendicular to both or at least one of the first major surface 36 or second major surface 38, but other arrangements are possible. The circumferential edge preferably includes a plurality of edge segments, including one or more curved edge segments, so as to define the overall outline of the hammer. In this embodiment of the present invention, the circumferential edge 42 delineates an outline that is approximately bell-shaped.

The hammer 22 includes a mounting hole or aperture 50 that is configured to receive the hammer mounting pin 32 in order to rotatably mount the shredder hammer to the rotary shredding head 18. The mounting hole 50 extends from the first major surface 36 to the second major surface 38 of the hammer, and forms a passageway through the hammer 22. The interior surface 52 of mounting hole 50 may be of any geometry that is compatible with the desired mounting pin and rotary shredding head with which the shredder hammer is intended to be used. Interior surface 52 may be shaped so that the mounting hole 50 is approximately cylindrical. Alternatively, the interior surface 52 of mounting hole 50 may define one or more curving surfaces such as are described in U.S. Pat. No. 8,308,094 (hereby incorporated by reference).

The hammer 22 may be characterized as having a proximal or mounting portion 46 and a distal or working portion 48. Hammer 22 includes a center of gravity axis CGA that passes through the center of hole 50 and a center of gravity CG for the hammer. The center of gravity axis CGA extends generally radially outward of pin 32 with the hammer in an unloaded operating steady state condition (i.e., rotating without load). The mounting portion 46 of hammer 22 includes mounting hole 50 for mounting hammer 22 to the head, and a lifting eye 54 to facilitate the handling and movement of the shredder hammer 22, which may be both extremely heavy and unwieldy. The lifting eye 54, when present, is preferably disposed on the circumferential edge 42 at the mounting portion. Lifting eye 54 is preferably along or near the center of gravity axis CGA. The mounting portion 46 and working portion 48 can be defined by a transverse axis TA that is perpendicular to the center of gravity axis and extending through the center of gravity CG, but could be positioned inward or outward of the center of gravity; i.e., the separation between the mounting portion and the working portion can be defined differently and may be different for different hammers. The transverse axis TA can be a line or an arc or other configuration that provides a differentiation of the two portions.

The major surfaces of shredder hammer 22 can include one or more concavities such as concavity 30 predominately in the mounting portion. Such concavities can have a rounded rectangular outline as shown or other shapes. Concavity 30 reduces the overall weight of the hammer without substantial reduction in operational effectiveness. During operation as the hammer spins at high speed, mass in the working portion where the shredding generally occurs, travels at a much higher velocity with greater momentum than mass in the mounting portion. The reduction in mass in mounting portion 46 has limited effect on the impact provided by the hammer and reduces the mass that is scrapped at the end of the service life of the hammer.

In this embodiment, rim surface 42 has a proximate or inner segment 42*a* along mounting portion 46 having a curved, generally semi-circular surface segment that circumscribes mounting hole 50. A leading side segment 42*b* and a trailing side segment 42*c* extend outward from opposite ends of inner segment 42*a*. The side segments 42*b*, 42*c* generally diverge in an outward direction toward the wear edge to provide a substantial mass in the working portion of the hammer for more effective shredding of the target material and to provide sufficient strength to accommodate a larger mass and long wear edge in the working portion. Side segments 42*b*, 42*c* can narrow somewhat, if desired, above the center of gravity CG before diverging outward for the working portion. Leading side segment 42*b* connects to the leading impact face 58 which faces forward to strike the material fed into the machine. While leading impact face 58 could have variety of orientations, it preferably extends generally in the direction of the center of gravity axis CGA. Impact face 58 is preferably generally planar but could have a rounded or other configuration. A trailing face 60 defines a second or secondary impact face to permit reversible mounting of the hammer after the leading portion of working portion 48 wears away; but a second impact face is not necessary. Leading and trailing faces 58, 60 connect with wear edge 56 at the leading and trailing ends 57 and 59. The leading impact face extends generally from the wear edge 56 inward toward the mounting hole (i.e., generally in the direction of the center of gravity axis CGA). The impact face 58 faces in the direction of rotation of the rotary shredding head 18 to provide a blunt face to strike the materials fed into the machine. A second face may be defined at a trailing end of wear edge 56 to permit reversible mounting of the hammer when the leading portion of the working portion 48 wears away.

The working portion 48 of hammer 22 includes the distal surface of circumferential edge 42 referred to as the outer surface or wear edge 56. Wear edge 56 faces outward and opposes grates 26 when rotating in an unloaded condition. The wear edge works with the grates to shred the material. In this embodiment, the wear edge 56 is defined as a convex arc along the distal edge of hammer 22. The shape of wear edge 56 as a convex arc helps prevent any undesired contact between the shredder hammer 22 and the walls of shredding chamber 16 or the anvil 24 as the shredder hammer rotates around mounting pin 32. An arcuate wear edge enables maximization of the mass in the working portion while still permitting the required clearance for the hammer to rotate about mounting pin 32. An arcuate wear edge also provides cooperation with the grate to effectively break up the material fed into the machine. The wear edge may be an arc of a circle defined by a radius or defined by a plurality of radii or by a continually changing arc. The arc is preferably defined by a radius with a center of curvature that is at or near the center of mounting hole 50 (i.e., at or near the axis of rotation of the hammer and the center of pin 32). Alternatively, the wear edge can be formed with planar or irregular surfaces or segments. The wear edge may be interrupted by recesses or slots through the hammer.

Figure 12:
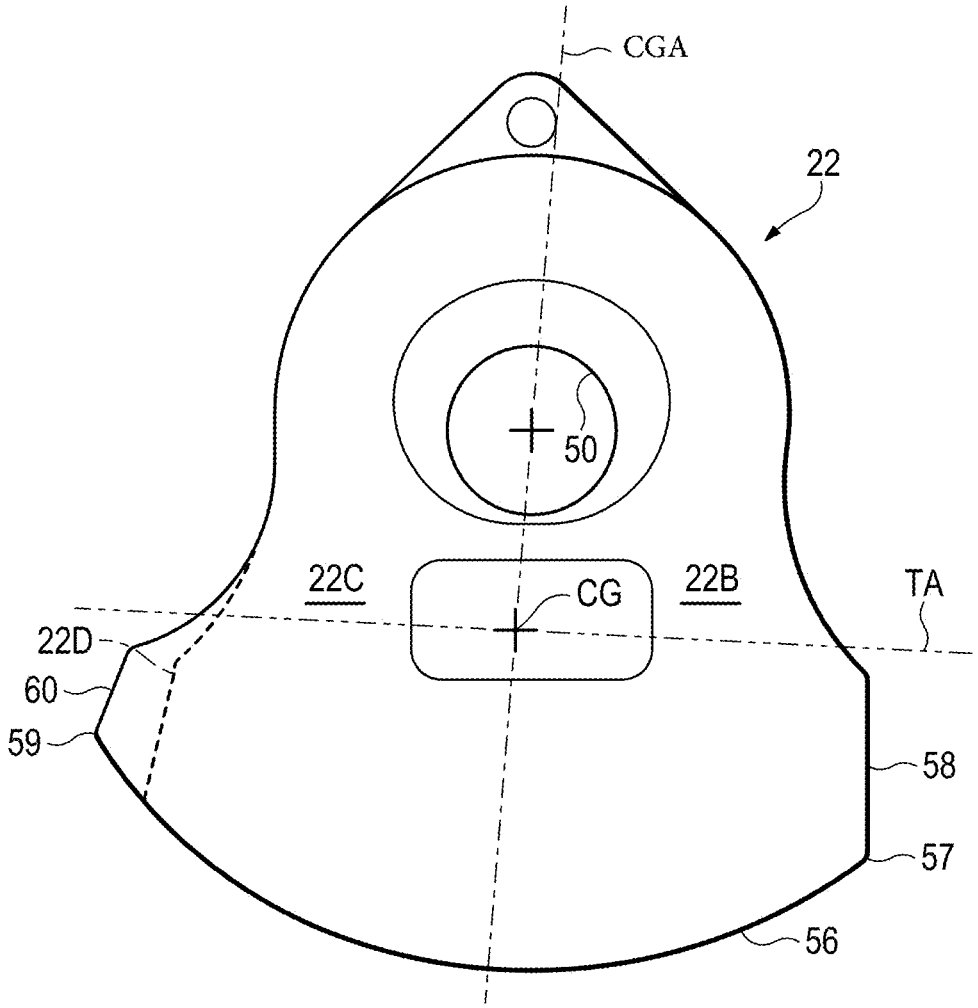
FIG. 12 is a front view of an inventive hammer with the leading edge periphery projected across the center of gravity axis.
Figure 13:
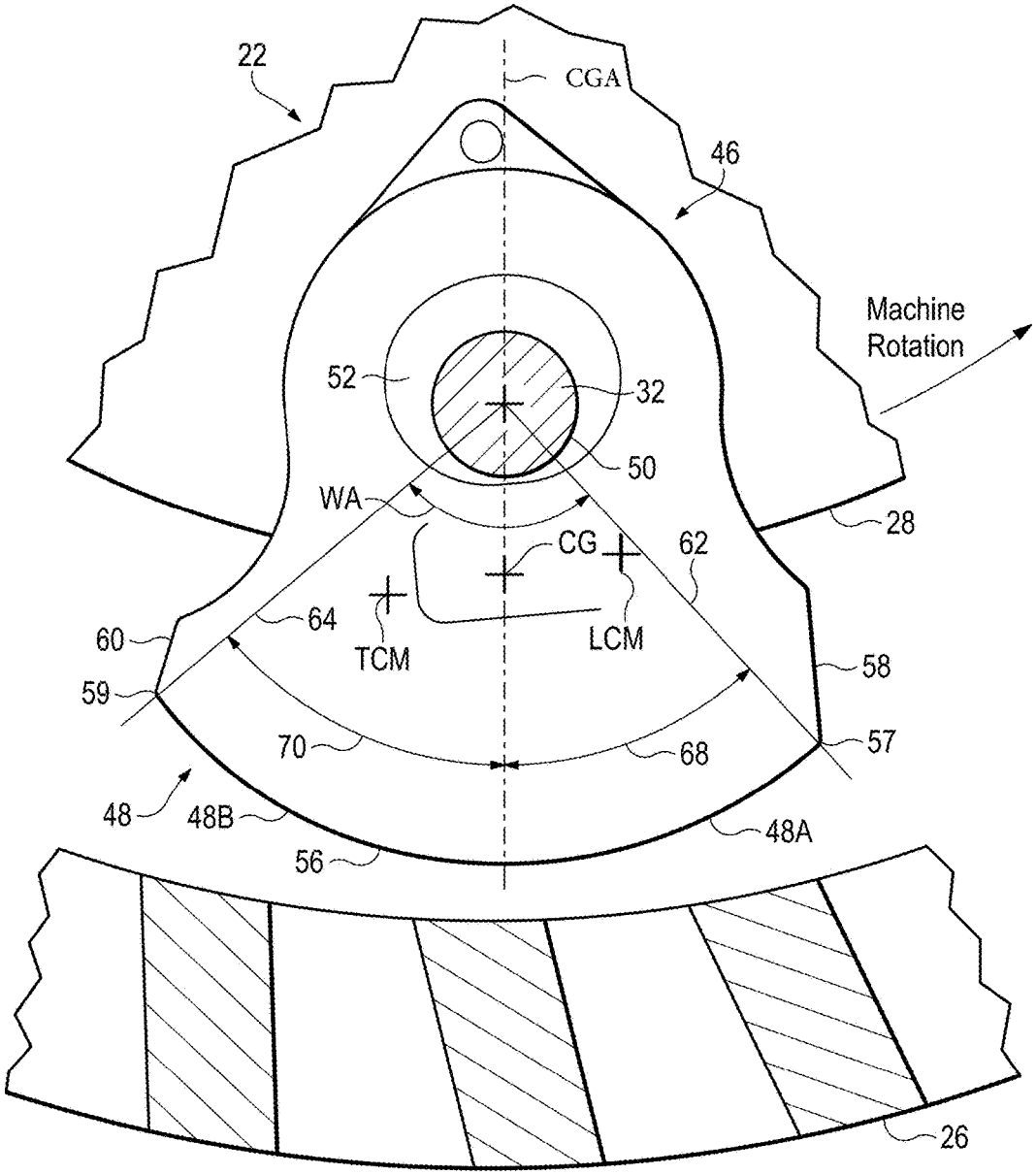
FIG. 13 is a cross section of a portion of a shredding system with an inventive hammer in an unloaded position.
Figure 14:
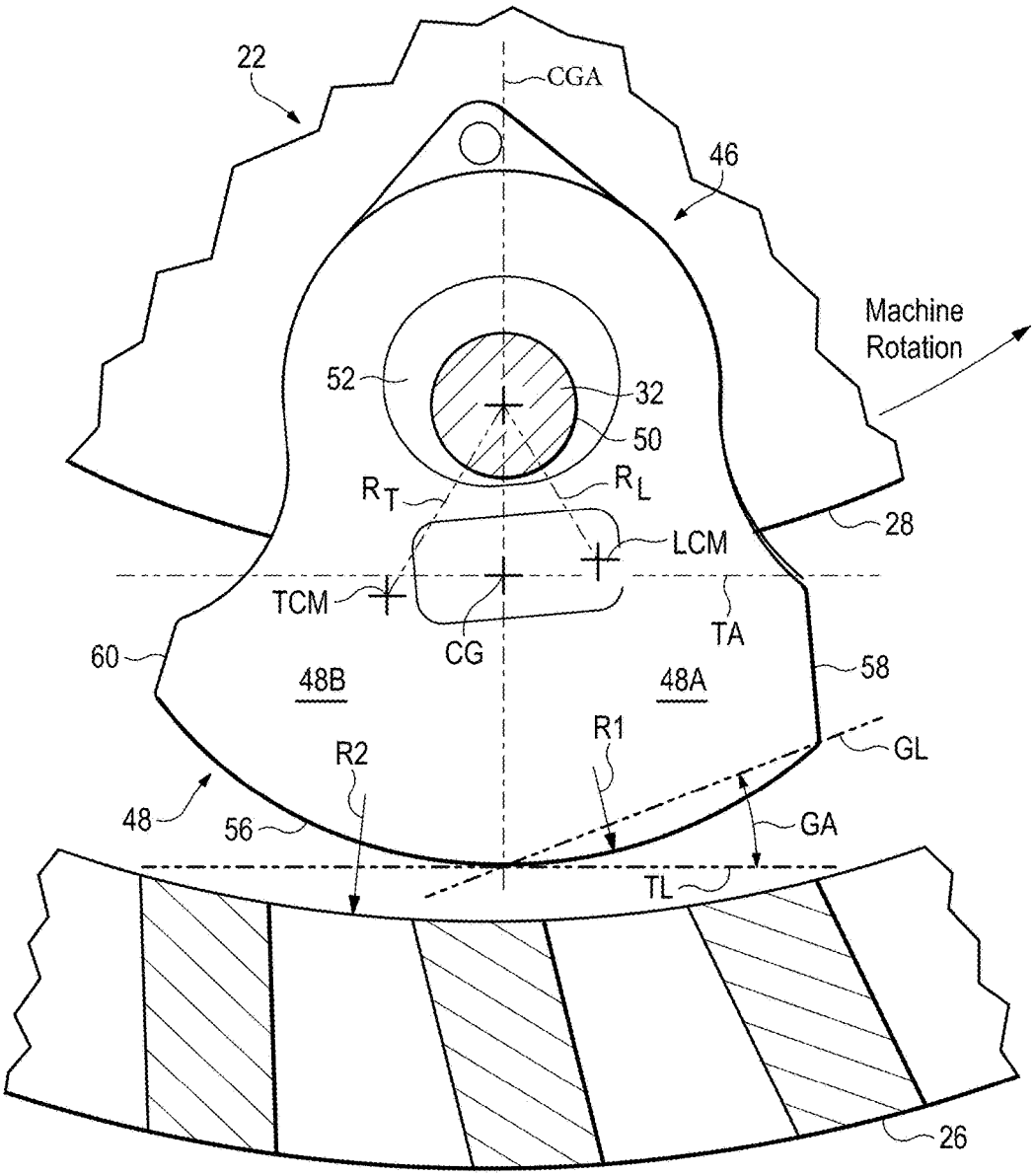
FIG. 14 is a cross section of a portion of a shredding system with an inventive hammer in an unloaded position.

Working portion 48 includes a leading portion 48*a* and a trailing portion 48*b* on opposite sides of the center of gravity axis CGA. As best seen in FIGS. 12 and 14, the trailing portion 48*b* extends laterally (i.e., perpendicular to the center of gravity axis CGA) farther from the center of gravity axis CGA than the leading portion 48*a*. The farther extension of the trailing portion 48*b* creates a greater lever that tends to bias the hammer forward as compared to conventional hammers.

Figure 11:
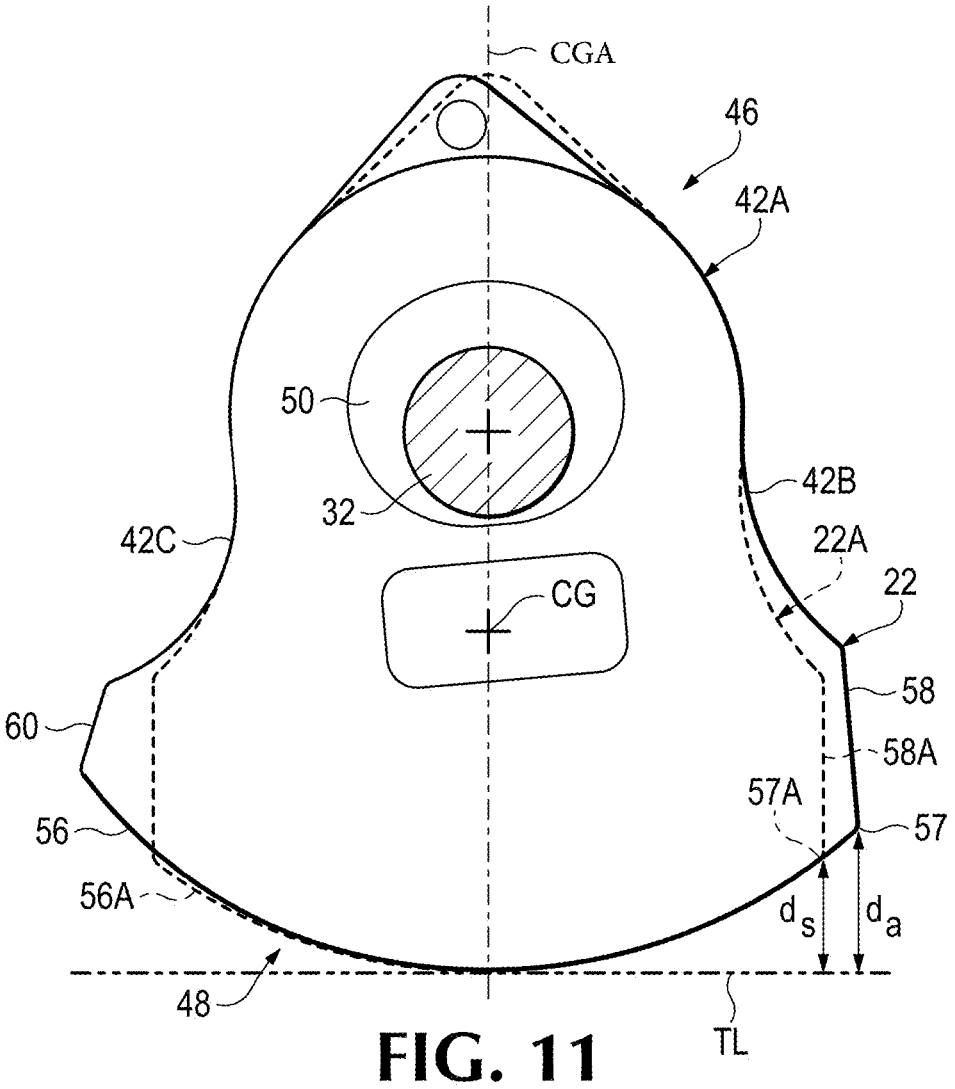
FIG. 11 is a front view of the inventive hammer with an outline of a symmetric hammer in phantom lines with a center of gravity CG axis passing through the center of gravity and center of the hole with the hammer in an unloaded steady state condition.

FIG. 11 shows an asymmetric hammer 22 with a superimposed conventional symmetric hammer 22A (shown in dashed line). Both hammers hang from the pin in an unloaded condition so the centers of gravity CG are aligned or superimposed and directly below the center of the pin. The forward side of the asymmetric hammer reflects a similar outline to the symmetric hammer for illustration, but the hammers may have a wide variation. Both hammers reference the same mounting pin center 32. As can be seen, hammer 22 provides a larger acceptance $d_a$ gap for receiving material between the hammer's wear edge and the grates as compared to the acceptance gap $d_s$ of the conventional symmetric hammer. The forward end or terminus 57 of wear edge 56 at the primary impact face 58 of hammer 22 is a greater distance $d_a$ from the transverse line TL than the corresponding point 57A on the symmetric hammer which is distance $d_s$ from the transverse line. The transverse line TL defines an outer datum that is perpendicular to the center of gravity axis CGA and crossing the intersection of the wear edge 56 and the center of gravity axis CGA. This provides a wider opening or gap for accepting the target materials to be separated and reduced and increases efficiency of the system.

The forward biasing provided by the farther rearward extending trailing portion 48*b* also tends to move hammer 22 forward to open acceptance gap $d_a$ more quickly than a symmetrical hammer. The initial larger opening and the return to an open acceptance gap more quickly each leads to a greater acceptance gap $d_a$ on the whole over the course of the operation than with a symmetric hammer. A larger acceptance gap $d_a$ during operation leads to more material being received between wear edge 56 and grates 26. The cooperative working of wear edge 56 and grates 26 more quickly shreds the material into pieces that discharge through the grates 56. It is further believed that the increased processing of the material between wear edge 56 and grates 26 tends to more finely shred the material than conventional hammers, which improves downstream separation processes to improve profitability of the operation. The larger acceptance gap also provides additional compression of material yielding a product with increased density and in turn an increased value of that shredded product.

In an alternative way of considering the invention, the trailing edge may extend beyond the leading edge that is projected or mirrored across the center of gravity axis. That is, the hammer can be considered as having a leading portion 22B with a leading perimeter or periphery on one side of the center of gravity axis and a trailing portion 22C with a trailing perimeter or periphery on the opposite side of the center of gravity axis. In FIG. 12 the projection or image of the leading portion 22B perimeter as reflected across the center of gravity axis is shown as a dotted line 22D overlaid on the trailing portion 22C. The trailing face 60 and trailing end 59 of the wear edge are outside of and/or extend beyond the mirrored leading perimeter and leading end 57 of the leading portion. Preferably, this extended mass of the trailing portion is spaced as far as possible (within strength and clearance limits) from the center of gravity axis to provide as much leverage as possible in biasing the hammer forward.

The hammer includes a leading axis 62 extending from the center of the hole 50 to the terminus or leading end 57 of the wear edge 56 with a leading angle 68 between the center of gravity axis and the leading axis. The hammer also includes a trailing axis 64 extending from the center of the hole 50 to the trailing terminus or trailing end 59 of the wear edge 56 with a trailing angle 70 between the center of gravity axis and the trailing axis. The farther rearward extension of trailing portion 48*b* extends the wear edge so that the trailing angle 70 is larger than the leading angle 68.

Material strength and stress in the mounting portion of the hammer limits the total mass of the working portion. The mounting portion of the hammer is subject to significant stress in supporting the working portion of the hammer during operation. Rotation of the hammer at high speed generates tensile stress in the mounting portion of the hammer to oppose centrifugal forces, and as the hammer working portion impacts material, it generates additional bending stress as well as material fatigue over repeated impacts. Excessive necking and reduced cross section of the mounting portion can increase stress resulting in cracking and failure of the hammer. Extending the trailing portion rearward and/or adding mass to the trailing edge to bias the hammer forward opens the acceptance gap with less mass than if the mass or extensions were added symmetrically to both sides to limit the stress on the hammer.

The advantages of the present invention may be seen from the perspective of an increase in volume of the acceptance gap to accept additional target materials for processing. FIG. 14 shows hammer 22 mounted to pin 32 in an unloaded condition with a wear edge 56 described at least in part by a radius R1 from near the center of hole 50. Wear edge 56 is opposite a portion of grate 26. Hammer 22 is sized to provide a clearance between the wear edge and the grate into which the material to be shredded is fed. The wear edge also needs to maintain a clearance from components of the head which supports the hammer. The clearance between the wear edge and the head components (such as when the hammer rotates about pin 32) may be less than the clearance between the wear edge and the grate and define the design limits of the wear edge.

The larger acceptance gap can be defined by the acceptance gap angle GA of the hammer. A gap line GL together with the transverse line TL, define the acceptance gap angle GA. Gap line GL in FIG. 14 extends from the intersection of the center of gravity axis CGA and wear edge 56 to leading end 57 of wear edge 56. The acceptance gap angle GA is defined between the outer datum (or transverse line) TL and the gap line GL. In the present invention, the acceptance gap angle GA is preferably at least 19 degrees. Displacing the center of gravity rearward causes the hammer to rotate forward on pin 32 and increases the volume of the acceptance gap between the wear edge and grate defined by transverse line TL and gap line GL. This increased acceptance gap accepts more material during operation for processing.

Terminus 57 may not be a physical location on the hammer; for example, the ends of wear edge may be chamfered or otherwise modified. In such a case, terminus 57 is defined by an extension of the arc (or other surface) defining the wear edge 56 and an extension of a line corresponding to the impact face 58. The arc of the wear edge or the face of the impact face may be interrupted by a notch or other feature that interrupts the expected extension of the lines. The arc defining the wear edge can have interruptions such as notches or steps while remaining a recognizable arc.

Figure 15:
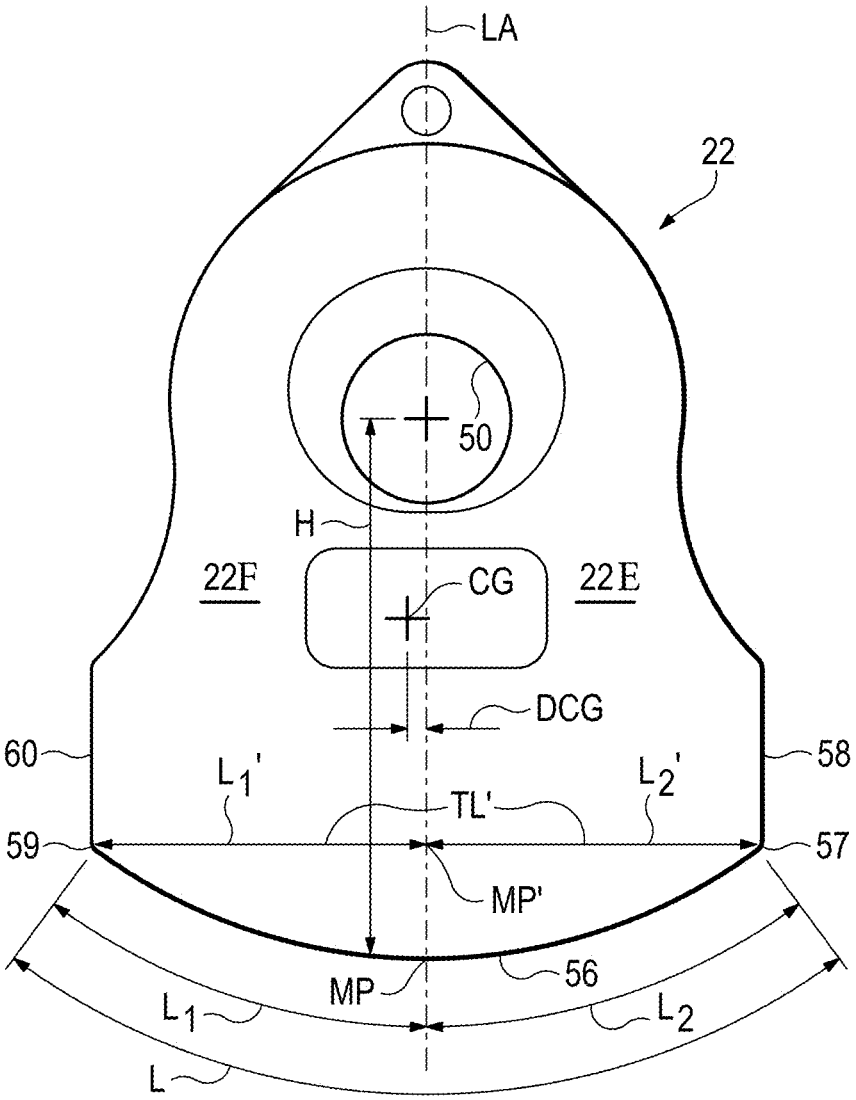
FIG. 15 is a front view of the inventive hammer.
Figure 16:
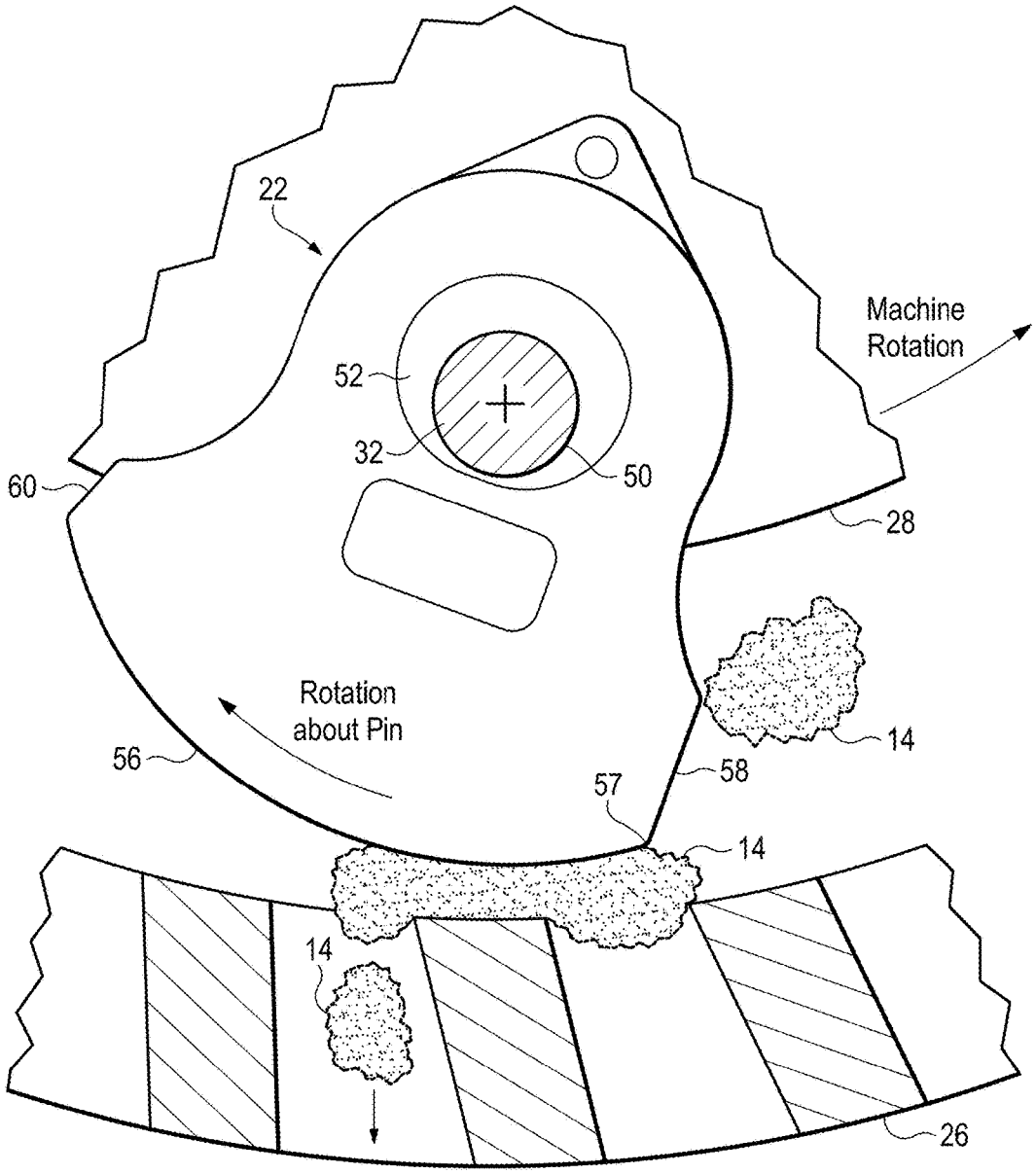
FIG. 16 is a cross section of a portion of a shredding system with a loaded inventive hammer rotated about the mounting pin showing material impacting the hammer and material between the hammer and the shredding system wall.

FIG. 15 shows the unloaded hammer of FIG. 14 in a loaded condition. Here material has been introduced into the system. Hammer 22 in response to material impacts and friction has rotated backward on pin 32. Target material 14 has entered the acceptance gap and is being crushed between wear edge 56 and grate 26. The increased acceptance gap accepts more material between the hammer and the grate resulting in higher production rates. Some crushed material 14 is shown passing through the opening of the grate to additional downstream processing. The higher material compression rate increases hardening of the hammer along the wear edge to provide an extended service life.

The advantages of the present invention can be seen from the perspective of an increase in length of the crush zone between the wear edge and the grate. Displacing the center or gravity rearward and subsequent rotation of the hammer forward on the pin lengthens the portion of the wear edge opening to accept target material. This added length increases the total crush zone and the efficiency of the reducing operation. As the material binds between the hammer and the grate the hammer rocks backwards again on pin 32 and the material is crushed and reduced in size.

Production throughput is also increased by an extended wear edge regardless of whether the hammer is symmetric or asymmetric. In a preferred embodiment, the width of the hammer is increased to provide improved shredding of the material fed into the machine. While throughput is optimized when the increased width is used with an asymmetric design (such as described above), the increased width improves production regardless of whether used with a symmetric or asymmetric hammer. The increased width is dependent on the size of the hammer. In accordance with the present invention, the ratio between the hammer height H (i.e., the distance between the center of mounting hole 50 and wear edge 56 along the longitudinal axis LA) and the length of the wear edge L is 0.75 or less. This enables the hammer to provide a lengthened wear edge without impairing the strength and durability of the hammer. Comparable conventional hammers with shorter wear edges have a H/L ratio that is greater than 0.75 and sometimes greater than 1.25. The lengthened wear edge gives the hammer more surface area over which to crush and shred the material in cooperation with the opposing grates.

In one preferred embodiment, the hammer operation is optimized with increased mass in the working portion in combination with a lengthened wear edge 56. A hammer in accordance with the present invention has a wear edge angle WA defined by the leading axis 62 and the trailing axis 64.

The leading region (i.e., on the leading side of the center of gravity axis) has a leading center of mass LCM, and the trailing region (i.e., on the trailing side of the center of gravity axis) has a trailing center of mass TCM. The mass in the working portion 48 is greater than in the mounting portion 46 such that the leading center of mass LCM and the trailing center of mass TCM are both located within the wear edge angle WA. In conventional hammers, the leading center of mass LCM and the trailing center of mass TCM are located near or outside the wear edge angle.

Additionally, the increased mass in the trailing portion of the working portion that shifts the center of mass away from the leading edge also shifts the trailing center of mass TCM toward the wear edge 56 and farther from the mounting hole than the leading center of mass LCM such that the distance Rt in FIG. 14 is greater than the distance RI. The trailing center of mass reflects the additional mass that biases the hammer forward and provides a torque or moment that rotates the hammer on pin 32. This rotation of the hammer opens the acceptance gap to more efficiently reduce material.

In an alternative embodiment the hammer includes more mass in the trailing section 22F than in the leading section 22E. A longitudinal axis LA defining the leading and trailing sections passes through the center of the hole and through a reference point other than the center of gravity. The reference point preferably is the wear edge midpoint defined by a point on the wear edge that is equidistant between the leading end 57 of the wear edge and the trailing end 59 of the wear edge as shown by L1 and L2 equal in length in FIG. 15. Alternatively, the reference point is the working end width midpoint equidistant on a transverse line TL' between leading end 57 of the wear edge and the trailing end 59 where L1' and L2' are equal in length. The additional mass of the trailing portion displaces the center of gravity of the hammer rearward away from leading edge 58 a distance Dcg from the longitudinal axis. The displaced center of gravity biases the hammer forward to provide a larger acceptance gap. To increase the mass in the trailing section of the hammer, the hammer could, for example, incorporate a more dense material in the trailing section. Alternatively, the leading section of the hammer could, for example, incorporate a lighter material or the leading section could incorporate a portion with a reduced thickness and less material. The hammer could also, for example, incorporate a cap or cladding that increases the mass in the trailing section.

The abrasive nature of the shredding operation causes the hammers to wear at a significant rate primarily at the wear edge proximate to the primary impact face. As the material wears away, the acceptance gap opens even farther. Erosion of the impact face at the same time makes the hammer less effective at initially impacting material against the anvil because it is spaced from the anvil, leaving a gap less effective at impacting the material and cannot crush the material to the original small volume. Erosion results in less wear edge surface area for crushing and shearing against the grate. The hammer becomes less efficient as the primary impact face and wear edge erodes away. The asymmetric hammer is advantageous in that the center of gravity is designed to be displaced rearward initially. As the material erodes away at the front of the hammer, the center of gravity is displaced even farther rearward and the hammer rotates forward on pin 32. This allows the rearward portion of the wear edge subjected to less wear to more effectively crush material against the grate and to continue to impact material, extending the effective service life of the hammer in the primary facing direction.

Typically, at a certain point in the service life of the hammer, the operator reverses the hammer on the head to a secondary facing position so that the secondary impact face 60 makes the initial impact. The secondary impact face area of the hammer experiences a much lower wear rate before reversing the hammer, so it retains initial dimensions optimized for initial impacts and a wear edge which remains effective for crushing and shearing against the grate. Reversing the hammer to utilize the secondary impact face can extend the service life of the hammer significantly.

It should be appreciated that although selected embodiments of the representative shredder hammers are disclosed herein, numerous variations of these embodiments may be envisioned by one of ordinary skill that do not deviate from the scope of the present disclosure. This presently disclosed shredder hammer design lends itself to use for both manganese and alloy hammer types, and the resulting hammers are well suited to a variety of shredding applications beyond metal shredding and metal recycling.

The disclosure set forth herein encompasses multiple distinct inventions with independent utility. The various features of the invention described above are preferably included in each hammer. Nevertheless, the features can be used individually in a hammer to obtain some benefits of the invention. While each of these inventions has been disclosed in its preferred form, the specific embodiments thereof as disclosed and illustrated herein are not to be considered in a limiting sense as numerous variations are possible. Each example defines an embodiment disclosed in the foregoing disclosure, but any one example does not necessarily encompass all features or combinations that may be eventually claimed. Where the description recites "a" or "a first" element or the equivalent thereof, such description includes one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

The invention claimed is:

1. A method of operating a shredding machine comprising mounting a hammer in a shredding chamber by a support pin through a mounting hole of the hammer, the hammer having a center of gravity, a center of gravity axis extending through a center of the mounting hole and the center of gravity, a leading portion on one side of the center of gravity axis including a leading surface that faces in the direction of hammer rotation in an unloaded steady state condition, and a trailing portion with a trailing surface on the other side of the center of gravity axis that extends laterally farther from the center of gravity axis than the leading portion where at least segments of the leading and trailing surfaces diverge as they extend away from the mounting hole, rotating the rotary shredding head such that the leading surface faces in the direction of rotation and feeding material into the shredding machine so that the leading surface impacts the target material fed into the shredding machine.

2. The method of claim 1 the hammer with a leading impact face, and a wear edge facing outward, the wear edge being longer rearward of the center of gravity axis than toward the leading impact face forward of the center of gravity axis.

3. The method of claim 1 the hammer with a wear edge having a leading end and a trailing end and facing outward, a leading axis extending from the center of the mounting hole to the leading end of the wear edge, and a trailing axis extending from the center of the mounting hole to a trailing end of the wear edge, wherein a trailing angle between the trailing axis and the center of gravity axis is greater than a leading angle between the leading axis and the center of gravity axis.

4. The method of claim 1 the hammer with a wear edge facing outward having a leading end, a longitudinal axis extending through a center of the mounting hole and a midpoint of the wear edge, a leading section on one side of the longitudinal axis including the leading surface at the leading end and a trailing section on the other side of the longitudinal axis that has more mass than the leading section.

5. The method of claim 1 the hammer with the leading portion on one side of the center of gravity axis having a leading center of mass, the trailing portion on the other side of the center of gravity axis having a trailing center of mass, a leading impact face, a wear edge facing outward having a leading end and a trailing end, a leading axis extending from the center of the mounting hole to the leading end of the wear edge, and a trailing axis extending from the center of the mounting hole to the trailing end of the wear edge, wherein the leading center of mass and the trailing center of mass is within an angle defined between the leading axis and the trailing axis.

6. The method of claim 1 the hammer with a wear edge facing outward remote from the mounting hole, and having a length, a longitudinal axis extending through a center of the mounting hole and a midpoint of the wear edge, and a height defined as the distance from the center of the mounting hole to the wear edge along the longitudinal axis, wherein the ratio of the height to the length of the wear edge is less than 0.75.

* * * * *